United States Patent [19]

Leifeld

[11] Patent Number: 4,486,921

[45] Date of Patent: Dec. 11, 1984

[54] APPARATUS FOR PRODUCING A LAP FOR A CARDING MACHINE

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 517,893

[22] Filed: Jul. 28, 1983

[51] Int. Cl.[3] ..... D01G 15/40

[52] U.S. Cl. ..... 19/105; 19/301

[58] Field of Search ..... 19/105, 301

[56] References Cited

U.S. PATENT DOCUMENTS

| | | | |
|---|---|---|---|
| 3,070,847 | 1/1963 | Schwab | 19/105 X |
| 3,728,759 | 4/1973 | Hergeth | 19/105 |
| 4,176,988 | 12/1979 | Lattmann | 19/105 X |
| 4,219,289 | 8/1980 | Trützschler | 19/105 X |

FOREIGN PATENT DOCUMENTS

| | | | |
|---|---|---|---|
| 878909 | 6/1953 | Fed. Rep. of Germany . | |
| 2004394 | 8/1971 | Fed. Rep. of Germany . | |
| 1685544 | 1/1972 | Fed. Rep. of Germany . | |
| 2415596 | 11/1974 | Fed. Rep. of Germany . | |
| 2532061 | 2/1977 | Fed. Rep. of Germany . | |
| 2939968 | 4/1981 | Fed. Rep. of Germany | 19/105 |

*Primary Examiner*—Louis K. Rimrodt

*Attorney, Agent, or Firm*—Spencer & Frank

[57] ABSTRACT

An apparatus for forming a fiber lap to be processed by a carding machine includes a generally vertically oriented feed chute having generally parallel and vertically oriented front and rear walls. The chute has an opening at the top for receiving fiber tufts and an opening at the bottom for delivering a fiber lap. An air stream is introduced into the chute for flow in the direction of the bottom thereof. Air exit openings are provided in the zone of at least one of the walls allowing the air stream to leave the feed chute. The depth of the feed chute measured horizontally at the height level of the air exit openings varies along the chute width, whereby a fiber lap of varying thickness along the lap width is produced.

7 Claims, 9 Drawing Figures

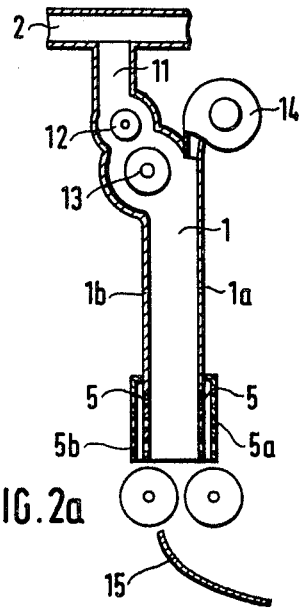
FIG. 2a
FIG. 2b
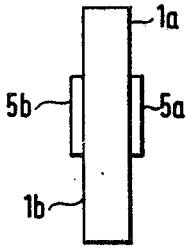
FIG. 2c
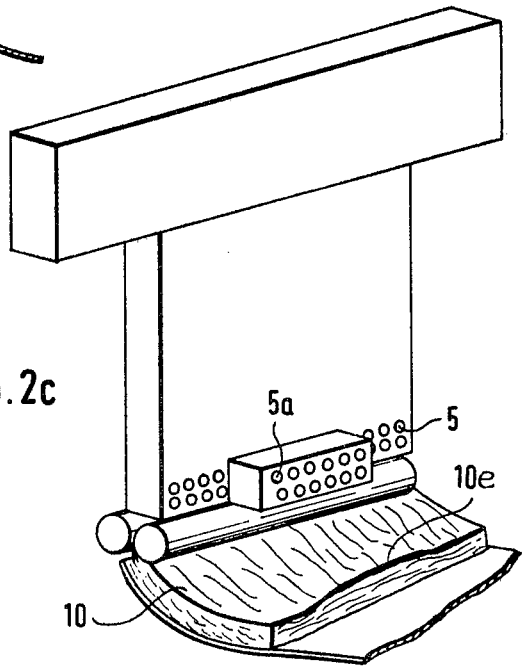

APPARATUS FOR PRODUCING A LAP FOR A CARDING MACHINE

BACKGROUND OF THE INVENTION

This invention relates to an apparatus for producing a lap for a carding machine or roller card wherein a feed chute for depositing the fiber tufts is disposed upstream of the machine, wherein the fiber tufts are fed into the feed chute from the top and are discharged therefrom at the bottom and wherein a stream of air enters the feed chute and leaves it through air exit openings provided on the front and/or rear wall of the feed chute.

It is known that laps of different height (thickness) can be produced by displacing one or both (front and rear) vertical walls of the feed chute to thus change the depth thereof. With such a device, however, the lap thickness only along the entire lap width can be varied.

SUMMARY OF THE INVENTION

It is an object of the present invention to produce a lap of varying height (thickness) along its width.

This object and others to become apparent as the specification progresses, are accomplished by the invention, according to which, briefly stated, the feed chute has a varying depth along its width at a height level where air exit openings are provided for obtaining a lap of varying thickness along its width.

According to a further feature of the invention, the depth of the feed chute is variable (adjustable) partially along the chute width. For this purpose, there is provided an adjustable wall element which partially changes the depth of the feed chute; that is, the feed of loose fiber tufts as well as the discharge of the tufts as a lap can be varied in at least one partial region along the chute width. In this manner a lap with varying thickness along its width may be produced. The wall element may contain air exit openings or may be solid, in which case it is situated at the height level of air exit openings provided in the chute wall opposite the wall element. The wall element directly cooperates with the tuft fill in the feed chute in the operating direction to thus determine the thickness of the lap. According to the invention, it is possible to produce in a simple manner, for example, a lap having thickened edge regions.

In a lap forming system having an upper reserve chute and a lower feed chute, for example, a tuft feeder for a carding machine or roller card, the lap thickness is expediently determined in the lower feed chute. The wall element may be part of the continuous front or rear wall and/or part of the front or rear arrangement for the air exit openings, such as a perforated component, sieve, or comb. By displacing, for example, an oblique wall element, the boundary face of the tuft fill in the chute can be shifted in an infinite variable (stepless) manner. In this way, the thickness of the lap is freely selectable without steps within the possible settings. The wall elements can be adjusted and immobilized externally of the chute if a constant lap thickness is required during the production period. For producing laps of a certain thickness in the operating direction, the wall elements may also be adjusted during operation. By coordinating the speed of the delivery rollers with the movement of the wall elements, any desired number of different lap thicknesses can be produced. This may lead to the reduction of waste. In case of a width-wise lap division, it is feasible to produce with a machine (such as an FBK model tuft feeder for cards, manufactured by Trützschler GmbH & Co. KG, Mönchengladbach, Federal Republic of Germany) several laps of different thicknesses which are, however, identical over their individual widths. For example, within certain limits it is possible to produce laps of different thickness next to one another in one roller card.

Expediently, the wall element is disposed in the feed chute and preferably forms part of the front or rear wall of the chute.

The invention can be used advantageously in very wide (2–3 m) feed chutes as well.

BRIEF DESCRIPTION OF THE DRAWING

FIG. 2*a* is a schematic side elevational view of a feed chute incorporating another preferred embodiment of the invention.

FIG. 2*b* is a schematic top plan view of the feed chute of FIG. 2*a*.

FIG. 2*c* is a schematic perspective view of the feed chute of FIGS. 2*a*, 2*b*.

DESCRIPTION OF THE PREFERRED EMBODIMENTS

Figure 1A:
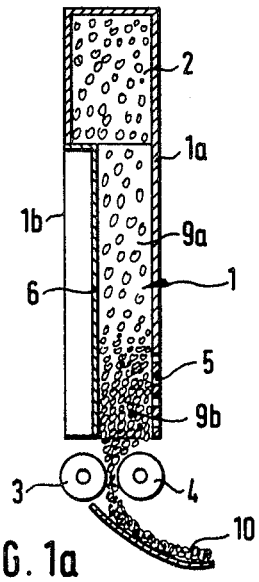
FIG. 1*a* is a schematic side elevational view of a feed chute incorporating a preferred embodiment of the invention.
Figure 1B:
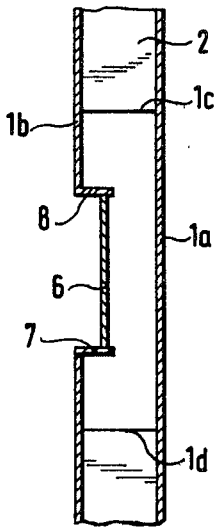
FIG. 1*b* is a schematic top plan view of the feed chute of FIG. 1*a*.

FIG. 1*a* shows a feed chute 1 which has a front wall 1*a* and a rear wall 1*b* and which is, with an upper fill opening for the fiber tufts, connected to a pneumatic transporting conduit 2. Two delivery rollers 3, 4 for discharging a lap 10 are disposed at the lower end of the feed chute. In at least one wall of the chute, preferably in the lower region of the front and/or rear wall, up to a certain height, there are provided air exit openings 5 which may be formed by a comb-like structure as disclosed in German Auslegeschrift (application published after examination) No. 1,286,436. Also referring to FIG. 1*b*, a wall element 6 which is part of rear wall 1*b* is disposed in feed chute 1 spaced, in its width, from side walls 1*c*, 1*d* of chute 1. Thus, as seen in FIGS. 1*a* and 1*b*, the depth of the feed chute, that is, the horizontal distance between the front and rear walls at a height lever where air exit openings 5 are provided varies along the chute width and further, by virtue of the displaceability of the wall element, such depth is variable. The upper end of the wall element 6 adjoins the connecting opening between transporting conduit 2 and feed chute 1 and its lower end is situated in the lower end of chute 1, above delivery rollers 3, 4. The lower end of wall element 6 is spaced from front wall 1*a* and from rear wall 1*b*. The upper region of wall element 6 extends into the upper region of feed chute 1. The wall element is arranged to be displaceable between two continuous vertical webs 7, 8 disposed at the interior of rear wall 1*b*.

The fiber tufts 9*a* float downwardly as individual tufts through the major portion of feed chute 1; in the center region of the chute, the depth of this path is reduced by wall element 6. In the lower portion of feed chute 1, there is then produced a tuft fill 9*b* of stacked fiber tufts pneumatically compressed from the top by a stream of air which leaves the feed chute through air exit openings 5 covered by the tuft fill. The compressed tuft fill 9*b* is removed as a lap from the lower end of feed chute 1 by delivery rollers 3, 4. It will be understood that the wall element 6 may be solid or may be provided with air outlet openings 5. In the latter case the front wall 1*a* may be void of air outlet openings 5.

Turning now to FIGS. 2*a*, 2*b* and 2*c*, an upper fiber material chute 11 is disposed between transporting conduit 2 and the lower feed chute 1 to enable the fibers to enter the feed chute 1 by means of a feed roller 12 and an opening roller 13. At the upper end of feed chute 1 there is disposed a fan 14 which directs a stream of air into feed chute 1. Below delivery rollers 3, 4 there is disposed a transfer element (tray) 15 for the lap 10. Along both the front wall 1*a* and the rear wall 1*b*, in a certain vertical length portion thereof, air outlet openings 5 are provided which extend throughout the entire width of the feed chute. The openings 5 may be provided either directly in the front and rear walls or may be constituted by apertures in a filtering (screen) surface, formed, for example, by a perforated component, a sieve, or a comb-like structure. Surface portions 5*a* and 5*b* (whether they are part of the front or rear chute wall or whether they are part of a filtering structure) are shifted (outwardly, in the embodiment shown) with respect to the plane of the front and rear walls 1*a* and 1*b*. Thus, the distance of the apertures 5 from the opposite chute wall varies as viewed horizontally along the width of the feed chute. Further, components 5*a* and 5*b* may be filter sections insertable in a filter surface at a desired location along the chute width and/or at a desired distance from the opposite chute wall or filter face to thus change the chute depth which varies along the chute width at the height level of the openings 5. If, for example, only one shifted section 5*a* is provided, such an arrangement results in a fiber lap 10 having, on one face thereof, a central portion 10*e* of increased thickness (height).

Figure 3A:
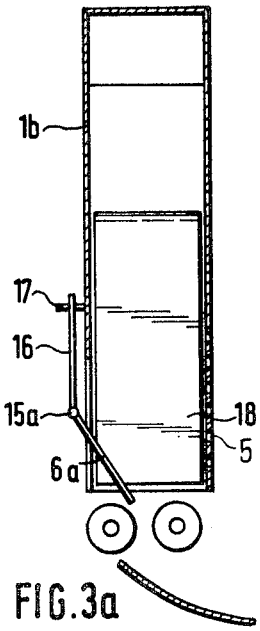
FIG. 3*a* is a schematic side elevational view of a feed chute incorporating still another preferred embodiment of the invention.
Figure 3B:
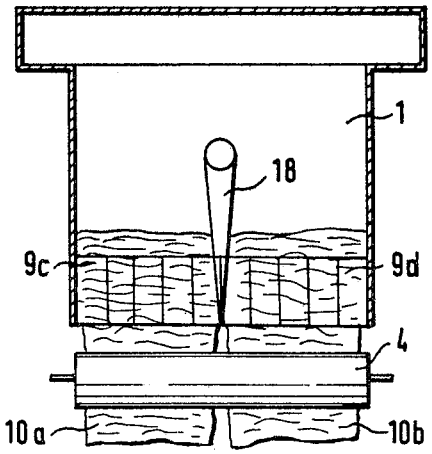
FIG. 3*b* is a schematic front elevational view of FIG. 3*a*.

Turning to FIG. 3*a*, a rotary joint 15*a* is disposed at the upper end of wall element 6*a* and is connected with a holding member 16 which is vertically displaceably connected with the rigid rear wall 1*b* of feed chute 1, by means of a fastening element 17. It is feasible to provide two wall elements 6*a* in those regions of rear wall 1*b* which adjoin the side walls of the chute. The displacement of holding member 16 and the setting of the oblique position of wall element or elements 6*a* may be effected in a stepless manner. Also referring to FIG. 3*b*, a vertical fiber tuft divider 18 is disposed in the feed chute 1 in the operating direction and divides the chute laterally into two partial chutes. The upper, rounded portion of the divider 18 may reach approximately the center of the feed chute 1, while the lower end of the divider 18 extends to the open bottom of the feed chute 1. The divider 18 thus separates the tuft column in chute 1 into columns 9*c* and 9*d* which leave feed chute 1 as a divided lap 10*a*, 10*b*.

Figure 4:
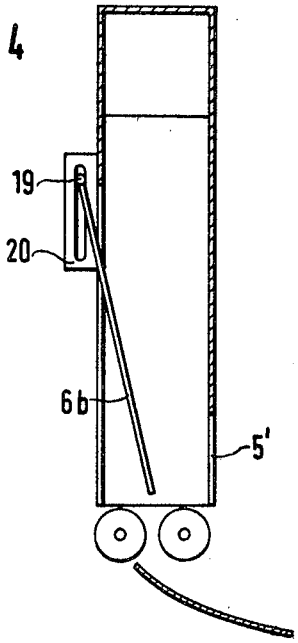
FIG. 4 is a schematic side elevational view of a feed chute incorporating a further preferred embodiment of the invention.

According to FIG. 4, a wall element 6*b* is associated with the rear wall 1*b* of feed chute 1 and its upper end engages in a holding device 20 through a slit (not shown) in rear wall 1*b*. The holding device 20 is mounted on the outer face of the rear chute wall 1*b*. The upper end 19 of the wall element 6*b* is arranged to be vertically displaceable in holding member 20 so that a different slope of the wall element 6*b* and thus a different depth (thickness) of the tuft fill can be set, since the distance of the elongated air exit openings 5' from the oppositely located wall element 6*b* varies.

Figure 5:
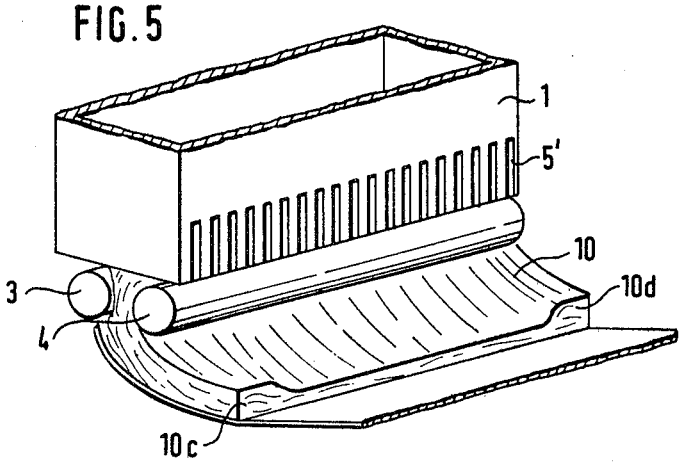
FIG. 5 is a perspective view of the lower portion of a feed chute and a fiber lap configured as a result of the invention.

FIG. 5 shows the lower portion of a feed chute 1 with the air exit openings 5' and the delivery rollers 3, 4. Lap 10 is reinforced (thickened) in its two outer edge regions 10*c*, 10*d*, since there, because of the effect of a wall element, such as wall element 6 of FIGS. 1*a* and 1*b*, more fiber material is filled into the side regions of feed chute 1 than in the central region thereof.

It will be understood that the above description of the present invention is susceptible to various modifications, changes and adaptations, and the same are intended to be comprehended within the meaning and range of equivalents of the appended claims.

What is claimed is:

1. In an apparatus for forming a fiber lap to be processed by a carding machine; said apparatus including a generally vertically oriented feed chute having generally parallel and vertically oriented front and rear walls, said chute having an opening at the top for receiving fiber tufts and an opening at the bottom for delivering a fiber lap; said feed chute having a width measured horizontally parallel to said walls and a depth defined by the distance between said walls; the fiber lap having a thickness determined by said depth; means for introducing a forced air stream into said chute for flow in the direction of the bottom thereof, and means for defining air exit openings in the zone of at least one of said walls allowing the air stream to leave the feed chute; the improvement wherein said depth measured at a height level of said air exit openings varies along said width for delivering a fiber lap of varying thickness along the lap width measured parallel to the width of the feed chute.

2. An apparatus as defined in claim 1, further comprising a wall element situated at least partially in said feed chute and having a dimension measured horizontally and parallel to said walls; said dimension being less than the width of said feed chute; and adjusting means for displacing said wall element in a direction parallel to the depth of said feed chute for varying said depth along one part of the width of said chute at a height level of said air exit openings for setting the thickness of said lap along one part of the lap width measured parallel to the width of the feed chute.

3. An apparatus as defined in claim 2, wherein at least some of said air exit openings are provided in said wall element.

4. An apparatus as defined in claim 2, wherein said wall element is situated in its entirety in said feed chute.

5. An apparatus as defined in claim 2, wherein said wall element forms part of one of said walls.

6. An apparatus as defined in claim 1, wherein said means for defining air exit openings comprises filter inserts.

7. An apparatus as defined in claim 6, wherein said filter inserts are mountable in said feed chute at desired positions for varying said depth.

* * * * *

UNITED STATES PATENT AND TRADEMARK OFFICE

CERTIFICATE OF CORRECTION

PATENT NO. : 4,486,921

DATED : December 11, 1984

INVENTOR(S) : Ferdinand Leifeld

It is certified that error appears in the above-identified patent and that said Letters Patent is hereby corrected as shown below:

On the title page:

In the heading of the patent, below [22], after "Jul.28, 1983", insert -- [30] Foreign Application Priority Data August 6, 1982 [DE] Fed. Rep. of Germany.....3229402 --.

Signed and Sealed this

*Twenty-eighth* Day of *May 1985*

[SEAL]

*Attest:*

DONALD J. QUIGG

*Attesting Officer*

*Acting Commissioner of Patents and Trademarks*